United States Patent [19]

Lerner

[11] 4,032,206

[45] June 28, 1977

[54] REMOTE VOLUME CONTROL PLUG

[76] Inventor: Jack Lerner, 337 W. 71st St., New York, N.Y. 10023

[22] Filed: Mar. 31, 1976

[21] Appl. No.: 672,293

[52] U.S. Cl. ..... 339/42; 339/183

[51] Int. Cl.[2] ..... H01R 17/18

[58] Field of Search ..... 339/42, 182, 183, 252 R, 339/252 P; 179/1 PC

[56] References Cited

UNITED STATES PATENTS

| | | | |
|---|---|---|---|
| 2,249,153 | 7/1941 | Martin | 339/183 |
| 2,544,102 | 3/1951 | Pease | 179/1 PC |
| 2,692,979 | 10/1954 | Withey, Jr. | 339/183 |
| 3,202,953 | 8/1965 | Bosworth et al. | 339/42 |
| 3,255,430 | 6/1966 | Phillips | 339/252 R |

*Primary Examiner*—Roy Lake
*Assistant Examiner*—Neil Abrams
*Attorney, Agent, or Firm*—Albert F. Kronman

[57] ABSTRACT

An electrical circuit plug for insertion into a current type socket without breaking the circuit normally connected through the socket contacts. When the plug is inserted into the socket, the plug terminals are connected in series with the output line connected to the socket and a manually variable resistor is connected to the plug terminals. The resistor is then varied to control the volume of a local transducer from a remote location. One of the plug contacts is a resilient conductor which makes electrical connection to one side of the output line.

4 Claims, 3 Drawing Figures

FIG. 1
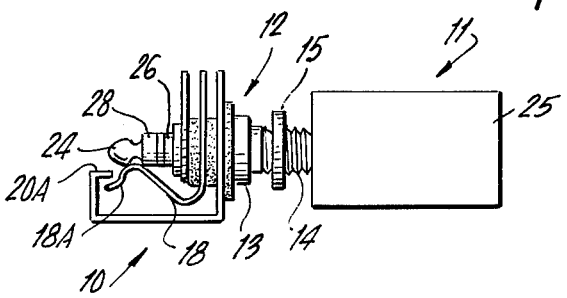
PRIOR ART
FIG. 2
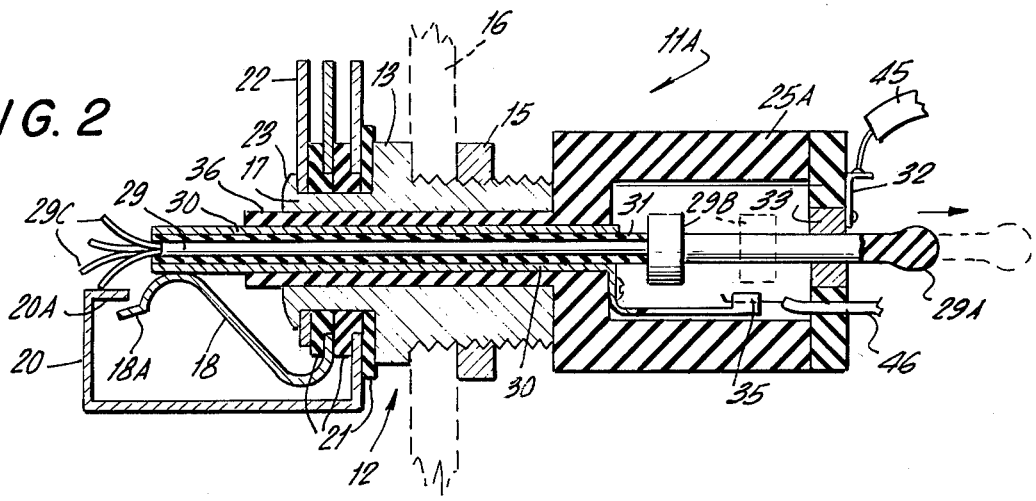
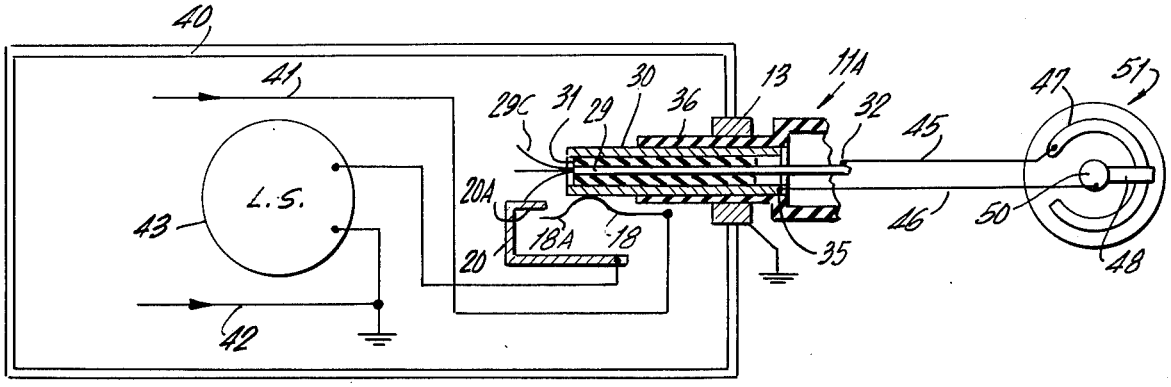
FIG. 3

REMOTE VOLUME CONTROL PLUG

BACKGROUND OF THE INVENTION

Most radio and television receiving sets are provided with output current sockets so that a remote loud speaker or head set may be pluuged into the socket and the output current diverted from the local loud speaker. The entire output current is then applied to a transducer connected to the plug. These sockets and plugs have been in use for many years and have operated in a satisfactory manner.

The present invention includes a plug for connection to a receiving set for remote volume control of the energy supplied to the local loud speaker. To do this the local socket contacts are broken and a series connection is made to the loud speaker terminals for sending the output current through a manually variable resistor. Connection with current break at the socket is accomplished by the use of a plurality of resilient axial connectors which make electrical contact with one of the socket contacts and opens the other socket current contact.

One of the features of the invention includes a plurality of preflexed contact filaments which expand after being pushed through the socket sleeve. The filaments expand in all directions and one or more of them makes contact with the desired socket terminal.

SUMMARY

The invention includes a plug for insertion into a standard type socket when the socket when the socket terminals are connected to the output of a circuit supplying voice frequency waves. The plug includes a cylndrical sleeve connected to one terminal of the plug and adapted to make contact with one portion of a spring switch within the socket. A plurality of spring contacts expand when they are pushed free of their tubular base and make contact with the other portion of the socket switch. Two axial conductors, insulated from each other and from the inside of the socket, lead to the two plug terminals and from there connect in series with a remote external variable resistor.

Additional details of the invention will be disclosed in the following description, taken in connection with the accompanying drawings.

BRIEF DESCRIPTION OF THE FIGURES

FIG. 1 is a side view of a prior art socket with a prior art plug inserted therein, flexing a contact spring and breaking a contact with a fixed spring.

FIG. 2 is a cross sectional view, taken along a median plane, of the socket shown in FIG. 1. A plug made in accordance with the present invention with an array of expanded curved filaments is shown in the socket.

FIG. 3 is partial schematic diagram of connections of the output portion of a receiving circuit and the plug of FIG. 2 connected to a manually operable variable resistor.

DESCRIPTION OF THE PREFERRED EMBODIMENTS

Referring to FIG. 1, a socket 10 and a plug 11 are shown joined in a conventional manner. The socket 10 includes a base support 12 having a flange 13, a threaded tube 14 and a clamping nut 15. The clamping nut 15 may be used to secure the socket to a panel 16 as shown in FIG. 2. A sleeve extension 17 (best shown in FIG. 2) supports the base portions of metal contact springs 18 and 20 in spaced relationship by means of insulator washers 21. A conductive washer 22 is mounted on the sleeve extension 17 and secured in place by a turned over portion 23. Washer 22 is used as one of the three terminals of the socket.

Fixed contact spring 20 extends outwardly from the flange 13, then parallel to the sleeve 17 and terminates in an inwardly bent contact portion 20A adapted to make contact with a contact 18A at the end of flexing spring 18. Flexing spring 18 is secured at its base between insulator washers 21 and extends in the direction of the free end 20A of fixed spring 20. Contact 18A is normally urged against the contact portion 20A of fixed spring 20.

The prior art plub, shown in FIG. 1 includes a tubular handle 25 and a conductive sleeve 26 which is coupled to the handle 25 by a helical thread 14. An axial rod 28, forming one of the electrical paths is terminated by a knob 24.

FIG. 2 shows the plug 11A with a tubular dielectric sleeve 36 and a movable axial metal rod 29 which in this form extends back through the handle 25A and terminates in a small dielectric sphere 29A. Rod 29 is also formed with a cylindrical boss 29B for restricting the axial movement of the rod. At the other end of rod 29 an array of metal filaments 29C are secured. The filaments 29C are pre-stressed to spread out like an umbrella when the rod 29 is pushed into its contact position (shown in FIG. 2). When the plug 11A is withdrawn from its socket, rod 29 is pulled to the right (as shown in dashed lines in FIG. 2) pulling all the filaments 29C into the insulator tube 31 for protection and for easy insertion into the socket 12 when it is to be used again.

Connections from a resistor element 47 (see FIG. 3) to the plug 11A are made by wire 45 soldered to conductive lug 32 which is in wiping contact with washer 33 (shown in FIG. 2); also, by conductive wire 46 soldered to lug 35, which in turn is connected to the tubular conductor 30. Tubular conductor 30 is insulated from metal rod 29 and from flange 13, and connects with the flexing spring 18 over which the voice frequency waves are applied. These conductors 29, 30 are connected in series with a local loud speaker transducer 43 and the normally closed spring contacts 18A, 20A in the socket.

When a conventional plug (as shown in FIG 1) is inserted into the socket, spring contcts 18A, 20A are opened and current to the loud speaker 43 is cut off. The output current then flows from conductor 24 to flexing spring 18, then through a conventional plug to a remote transducer (not shown) and back through the plug sleeve 26, to flange 13 and washer 22.

When plug 11A is inserted into the socket 12, (FIGS. 2 and 3) connection is made to flexing spring 18 and fixed contact spring 20 by means of tubular conductor 30 and rod filaments 29C while opening contact 18A. The transducer 43 continues to receive current but the tubular conductor 30 and rod 29 are connected in series with wires 41 and 42 and the current flows from conductor 41, to flexing spring 18, tubular conductor 30, conductor 46, variable resistor 47, conductor 45, rod 29, filaments 29C, fixed contact spring 20, transducer 43, to the other supply conductor 42. Resistor 51 may take several forms, the one shown in FIG. 3 having a circular resistive element 47 and a sliding contact 48 revolving around a central pivot position and controlled by a manual knob 50. Variation of the resistance in the plug circuit controls the current sent through the transducer 43 and hence its volume.

A variable impedance, including capacitors and reactors, can be substituted for the variable resistance 47 but this is not recommended since any type of impedance in shunt with a transducer alters the tonal quality of the sound produced by it.

From the above it is evident that a useful type of series connected plug has been developed for use with current type sockets. Volume control of a transducer is made possible at a remote location.

Having thus fully described the invention, what is claimed as new and desired to be secured by Letters Patent of the United States is:

1. A plug for insertion into a standard type current socket connected to the output of a circuit producing voice frequency waves comprising: a fixed and a flexing spring contact in the socket; an axial tubular conductor connected to one terminal of the plug and adapted to make contact with the flexing spring contact; an axial conductive rod within the tubular conductor for connection to a second plug terminal: an insulator tube between the tubular conductor and axial rod; an array of prebent outwardly divergent conductive filaments for electrical connection to the fixed spring contact in the socket secured to and extending from the said rod for connecting the plug terminals in series with the socket contacts, and a variable resistive element connected to said terminals.

2. A plug according to claim 1 wherein said array of prebent filaments is slidably carried ad compressed within the insulator tube to expand after insertion of the plug to make contact with a socket contact spring.

3. A plug according to claim 2 wherein the axial rod is axially movable and the elongated resilient conductor is connected to the said axially movable rod for pulling the filaments into the insulated tube when the plug is inserted or withdrawn from the current socket.

4. A plug according to claim 1 wherein said variable resistance includes a manually operable sliding contact.

* * * * *